US011376654B2

(12) United States Patent
Gihleengen

(10) Patent No.: US 11,376,654 B2
(45) Date of Patent: Jul. 5, 2022

(54) CASTING METHOD AND CASTING APPARATUS FOR DC CASTING

(71) Applicant: NORSK HYDRO ASA, Oslo (NO)

(72) Inventor: Britt Elin Gihleengen, Ålvundeid (NO)

(73) Assignee: NORSK HYDRO ASA, Oslo (NO)

( * ) Notice: Subject to any disclaimer, the term of this patent is extended or adjusted under 35 U.S.C. 154(b) by 0 days.

(21) Appl. No.: 17/425,017

(22) PCT Filed: Jan. 15, 2020

(86) PCT No.: PCT/EP2020/050917
§ 371 (c)(1),
(2) Date: Jul. 22, 2021

(87) PCT Pub. No.: WO2020/156813
PCT Pub. Date: Aug. 6, 2020

(65) Prior Publication Data

US 2022/0176443 A1 Jun. 9, 2022

(30) Foreign Application Priority Data

Feb. 1, 2019 (NO) ..... 20190143

(51) Int. Cl.
*B22D 11/049* (2006.01)
*B22D 11/04* (2006.01)
(Continued)

(52) U.S. Cl.
CPC ..... *B22D 11/049* (2013.01); *B22D 11/0401* (2013.01); *B22D 11/055* (2013.01);
(Continued)

(58) Field of Classification Search
CPC . B22D 11/049; B22D 11/0401; B22D 11/055; B22D 11/148; B22D 11/22;
(Continued)

(56) References Cited

U.S. PATENT DOCUMENTS

| | | | |
|---|---|---|---|
| 5,548,520 | A | 8/1996 | Nakamura et al. |
| 2002/0033246 | A1 | 3/2002 | Saether et al. |
| 2009/0008059 | A1 | 1/2009 | Jacques et al. |

FOREIGN PATENT DOCUMENTS

| | | |
|---|---|---|
| JP | 63-207459 | 8/1988 |
| JP | 2002-028764 | 1/2002 |
| WO | 97/16273 | 5/1997 |

OTHER PUBLICATIONS

International Search Report and Written Opinion of the International Searching Authority dated Feb. 14, 2020, in International (PCT) Application No. PCT/EP2020/050917.

*Primary Examiner* — Kevin P Kerns
*Assistant Examiner* — Steven S Ha
(74) *Attorney, Agent, or Firm* — Wenderoth, Lind & Ponack, L.L.P.

(57) ABSTRACT

A method for casting longitudinal cast products including casting longitudinal cast products in a semi-continuous manner using a DC casting apparatus having a mold, wherein the mold has top and bottom openings and partially solidifies molten metal that enters into the mold via the top opening and outputs the cast product via the bottom opening, recording a thermal image of the cast product output via the bottom opening, determining at least three non-overlapping temperature ranges comprising a first, second and third, determining a peak temperature in the thermal image; comparing the peak temperature with the at least three temperature ranges; and performing operations depending on where the peak temperature falls within the at least three temperature ranges.

14 Claims, 3 Drawing Sheets

(51) Int. Cl.

| | |
|---|---|
| ***B22D 11/055*** | (2006.01) |
| ***B22D 46/00*** | (2006.01) |
| ***B22D 11/20*** | (2006.01) |
| ***B22D 11/22*** | (2006.01) |
| ***B22D 11/14*** | (2006.01) |

(52) U.S. Cl.
CPC ..... *B22D 11/148* (2013.01); *B22D 11/202* (2013.01); *B22D 11/22* (2013.01); *B22D 46/00* (2013.01)

(58) Field of Classification Search
CPC ..... B22D 11/16; B22D 11/18; B22D 11/182; B22D 11/185; B22D 11/188; B22D 11/20; B22D 11/202; B22D 11/204; B22D 46/00
See application file for complete search history.

CASTING METHOD AND CASTING APPARATUS FOR DC CASTING

TECHNICAL FIELD

The present invention relates to an apparatus and a method for the efficient casting of longitudinal cast products such as rolling ingots or extrusion ingots or forging stock.

TECHNICAL BACKGROUND

Casting of longitudinal casting products is carried out using a direct chill (DC) casting apparatus. Such a DC casting apparatus comprises a mold that is configured to at least partially solidify molten metal that is introduced into the mold via a top opening. The at least partially solidified molten metal, which corresponds to the cast product, exits the mold via a bottom opening and is supported by a vertically moveable starter block. The longitudinal cast product is produced by continuously supplying molten metal into the mold while moving the starter block that supports the cast product produced from the molten metal vertically downwards. A cast product may for example have a length of 1 to 5 meter, although the cast product may have any length. After casting a cast product, the flow of molten metal into the mold is interrupted, the cast product is removed from the starter block, and the starter block is moved vertically upwards to close the bottom opening of the mold. Starting from this configuration, the next cast product can be cast. As each cast product individually is cast in a continuous steady-state manner and as there are interruptions between casting of subsequent cast products, the process is referred to as a "semi-continuous casting process". In the following, it will also be referred to as "DC casting" or "casting".

US application No. 2002/0033246 A1 discloses a cooling system for DC semi-continuous casting equipment for casting metal, in particular casting aluminium ingots. The DC semi-continuous casting equipment comprises one or more chills arranged in a frame structure with an integral water distribution box, which chill(s) comprise(s) a mold chamber surrounded by permeable wall elements for the supply of oil and/or gas and is(are) open at the top with an opening for the supply of molten metal and, at the start of each casting operation, the chill(s) is(are) closed at the bottom by means of a movable support. The metal is cooled in two stages, by primary cooling in the mold chamber and secondary cooling by direct water cooling immediately below the primary cooling area.

A slab or rolling slab is a cast product that is subsequently used in a rolling process to e.g. produce foil or sheet metal and the like and that may have a rectangular cross-section. An extrusion billet is a cast product that is subsequently used for extrusion and may have a circular cross-section. However, the cast products producible by DC casting are not limited to subsequent use for rolling or extrusion but may also be used for forging or other forming methods.

A common problem during DC casting is a phenomenon known as "bleed-out". A bleed-out occurs when the molten metal spills out of the bottom opening of the mold in uncontrolled and undesired manner. A bleed-out may put personnel at risk and also might permanently damage the casting apparatus and cause production down-time. FIG. 1 shows a visible-light image of a bleed-out in a DC casting apparatus while casting of a cast product that is intended to have a circular cross-section. So far, the reasons and mechanisms that lead to a bleed-out have not been fully established.

WO 97/16273 A1 relates to the problem of bleed-out during DC casting. WO 97/16273 A1 discloses a bleed-out detector for detecting bleed-outs in DC casting of molten metals, including a detection means for detecting the presence of molten metal at an exterior surface of a casting. If a bleed-out is detected the detection means sends a signal to an alarm to trigger an appropriate corrective action.

As bleed-outs may put personnel at risk and also might permanently damage the casting apparatus and cause production down-time there is a desire to avoid, or at least reduce the risk of bleed-outs during DC casting.

Short Description of the Invention

It is an objective of the present invention to enable a more efficient semi-continuous casting process. It also an objective of the present invention to prevent, or at least reduce, the risk of bleed-outs during semi-continuous DC casting. To solve these and other objects, the present invention provides a method for casting longitudinal cast products comprising: casting longitudinal cast products in a semi-continuous manner using a DC casting apparatus having a mold, wherein the mold has top and bottom openings and is configured to at least partially solidify molten metal that is entered into the mold via the top opening and to output the cast product via the bottom opening, recording a thermal image of the cast product that is output via the bottom opening, determining (defining) at least three non-overlapping temperature ranges comprising a first temperature range, a second temperature range and a third temperature range, determining a peak temperature in the thermal image; comparing the peak temperature with the at least three temperature ranges; and a.) when the peak temperature is comprised in the first temperature range, casting the cast product, b.) when the peak temperature is comprised in the second temperature range, displaying an information indicative of a maintenance requirement of the casting apparatus and carrying out maintenance of the casting apparatus after the cast product is cast and before a subsequent casting operation is carried out, c.) when the peak temperature is comprised in the third temperature range, aborting the casting of the currently cast cast product and displaying an information indicative of an emergency shutdown.

According embodiments of the method, the aborting may be carried out automatically (e.g. using an electronic control unit). According to embodiments of the method according to the invention, the aborting may be carried out by an operator (that is, by a person) based on the displaying of the information indicative of an emergency shutdown. According to embodiments, the invention provides an apparatus for carrying out the method described herein.

According to embodiments of the method according to the invention, the first temperature range comprises temperatures up to but not including 70° C.

According to embodiments of the method according to the invention, the second temperature range comprises temperatures between 70° C. and 90° C.

According to embodiments of the method according to the invention, the third temperature range comprises temperatures higher than and not including 90° C.

According to embodiments of the method, molten metal is at least partially solidified by removing heat from the mold cavity into a cooling jacket circulating a cooling medium.

According to embodiments of the method, the cast product is further solidified by direct water cooling immediately below the cooling jacket (34) or in the bottom opening (32) of the mold.

According to a further aspect, the invention provides a casting apparatus for semi-continuous direct chill casting of longitudinal cast products comprising a mold having a mold cavity and a top opening and a bottom opening that are in fluid communication with the mold cavity, wherein the mold is configured to at least partially solidify molten metal that is supplied into the mold cavity, a metal supply system for selectively supplying molten metal from a reservoir into the mold cavity via the top opening, a starter block that is configured such as to be vertically moveable between a high position in which it closes the bottom opening of the mold and a low position, and wherein a cast product is produced by vertically moving the starter block from the high position to the low position while supplying molten metal into the mold cavity, a thermal camera, that is configured to record a thermal image of the cast product while the starter block is moved from the high position to the low position, an electronic control system that is configured to determine a peak temperature in the thermal image and compare the determined peak temperature with at least a first pre-defined temperature range, a second pre-defined temperature range and a third pre-defined temperature range, to control metal supply via the metal supply system and to control a vertical movement of the starter block, an information output system for outputting an information, wherein the electronic control system controls the metal supply system and the starter block such as to produce a cast product when the peak temperature is comprised in the first pre-defined temperature range, wherein the electronic control system controls the metal supply system and the starter block such as to produce a cast product and controls the information output system to output an information indicating that maintenance of the casting apparatus is necessary when the peak temperature is comprised in the second pre-defined temperature range, wherein the electronic control system controls the metal supply system to stop supply of molten metal from the reservoir into the mold cavity such as to abort casting of the cast product, when the peak temperature is comprised in the third pre-defined temperature range.

According to embodiments of the invention, the first pre-defined temperature range comprises temperatures up to but not including 70° C.

According to embodiments of the invention the second pre-defined temperature range comprises temperatures between 70° C. and 90° C.

According to embodiments of the invention the third pre-defined temperature range comprises temperatures higher than and not including 90° C.

According to embodiments of the invention, the thermal camera is arranged below the bottom opening of the mold to record a thermal image of the cast product at least in the area immediately below the bottom opening of the mold.

According to embodiments of the invention, the mold comprises a cooling jacket for circulating a cooling medium.

According to embodiments of the invention, the casting apparatus comprises secondary cooling by direct water cooling of the cast product after formation of a solidified skin on the molten metal.

As in generally known in the technical field DC casting apparatus may comprise more than one molds, for casting more than one cast products simultaneously, e.g. as illustrated in US 2002/0033246 A1. It should be understood that the method and the casting apparatus of the present invention includes DC casting apparatus having more than one mold, hence, the term "mold" used herein should be understood to include the plural form "molds". Further, it should be understood that more than one thermal camera or thermal imaging device may be arranged to record thermal images of the cast product, especially when the DC casting apparatus comprises more than one mold for producing more than one cast product simultaneously. Therefore, the term "thermal camera" and "thermal imaging device" should be interpreted to include the plural form of the terms.

SHORT DESCRIPTION OF THE FIGURES

DETAILED DESCRIPTION

Figure 1:
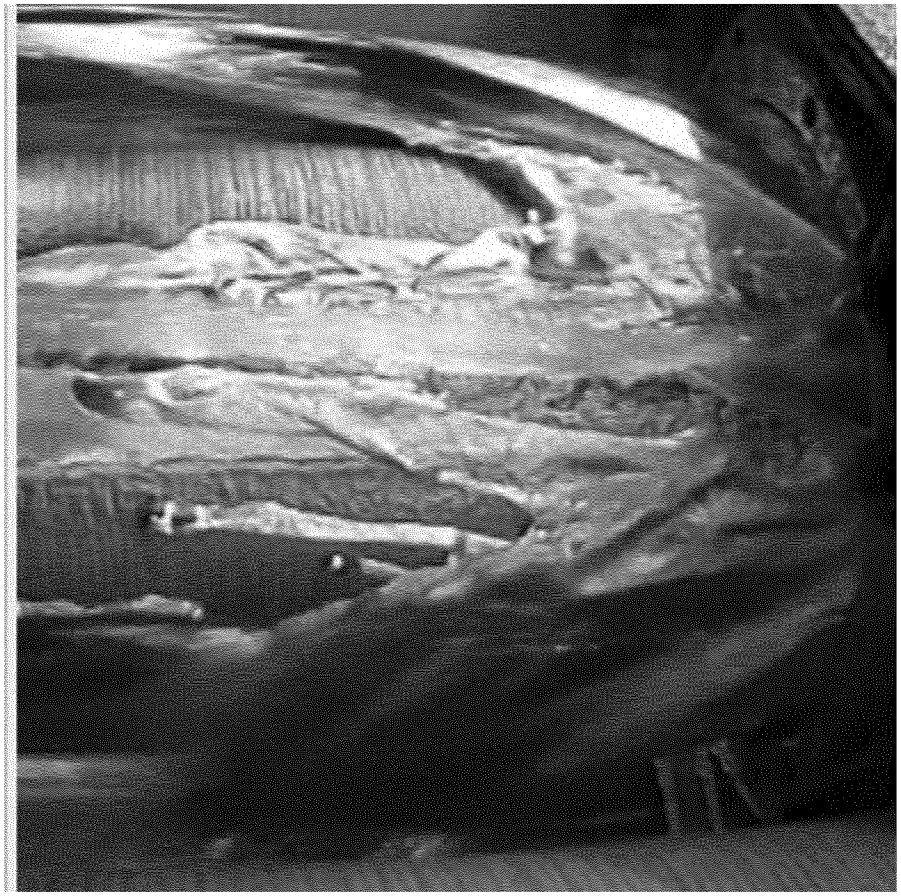
FIG. 1 shows a bleed-out in a DC casting apparatus during casting of a cast product.
Figure 2:
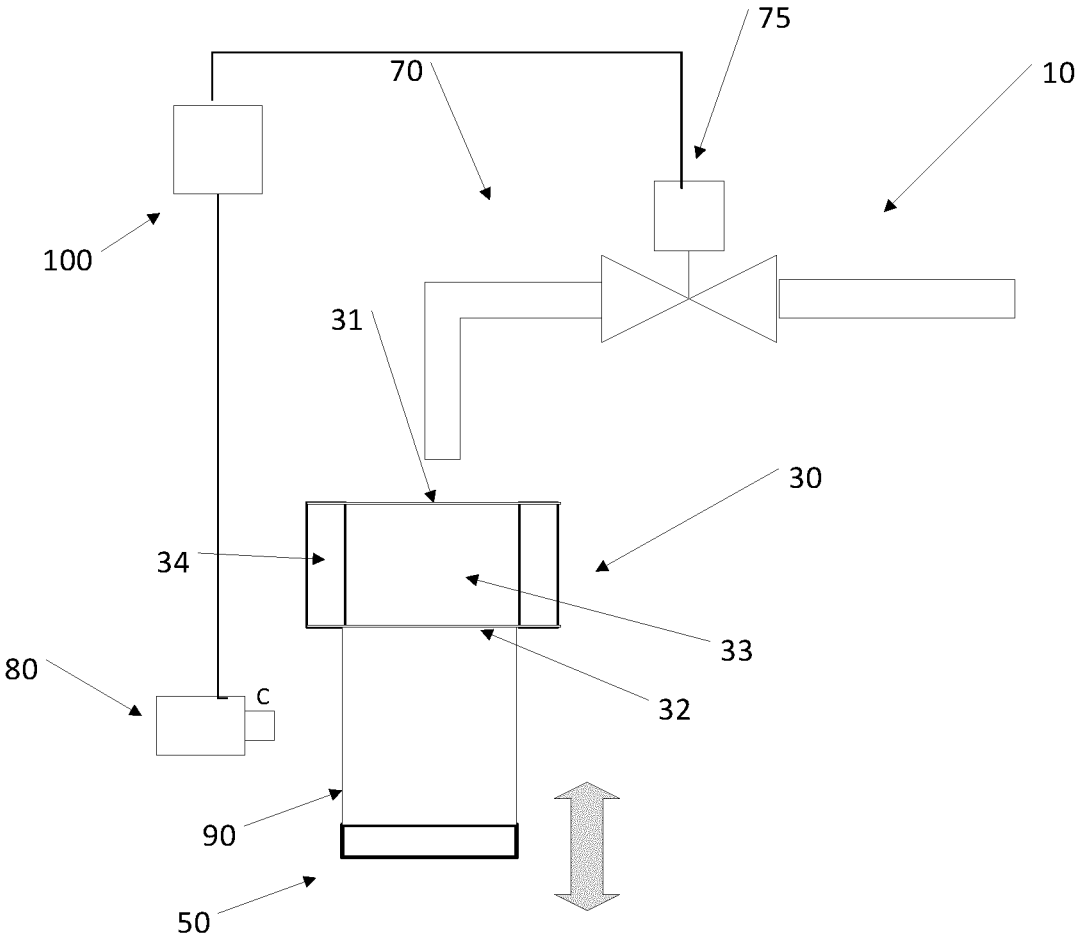
FIG. 2 shows a schematic view of a DC casting apparatus according to embodiments of the invention for carrying out the method according to the invention.

With reference to FIG. 2, a DC casting apparatus 10 according to embodiments of the invention comprises a mold 30.

The mold 30 has a top opening 31 and a bottom opening 32 and a mold cavity 33 that is in fluid communication with the top and bottom openings 31, 32. The mold 30 may further comprise a cooling jacket 34 for circulating a cooling medium such as water. The cooling jacket 34 may serve to remove heat from the mold cavity 33 via heat conduction from the mold cavity into the cooling medium which transports heat away, e.g. to a heat exchanger (not shown). As is generally known in the art, the molten metal is cooled in two stages, by primary cooling in the mold cavity to form an outer solidified layer on the molten metal, e.g. by a cooling jacket 34 as illustrated in FIG. 2, and secondary cooling by direct cooling, e.g. direct water cooling, immediately below the primary cooling area, not shown in FIG. 2. The direct cooling, e.g. direct water cooling, may be arranged immediately below the cooling jacket, and/or in the bottom opening (32) area of the mold where the cast product exits the mold.

The casting apparatus 10 further comprises a starter block 50. The starter block 50 is arranged such as to be able to selectively open or close the bottom opening 32 of the mold 30 by a vertical movement of the starter block 50. The starter block 50 is arranged below the bottom opening 32 and is vertically moveable to close the bottom opening 32 (when it is in its top most position) and to open the bottom opening 32, (when it is moved vertically downwards). The double arrow in FIG. 2 indicates the vertical movability of the starter block 50.

The DC casting apparatus 10 further comprises a metal supply system 70 configured to supply liquid metal, in particular molten aluminium or molten aluminium alloy, from a reservoir, such as a melting furnace or crucible, into the mold cavity 33 via the top opening 31 of the mold 30. The metal supply system 70 may comprise means 75 for stopping the metal flow into the mold cavity 33. The means 75 for stopping the metal flow may for example be implemented as a valve, e.g. a gate valve or dam or as an opening-plug-combination, provided on a conduit connecting the reservoir and the mold cavity 33 as shown in FIG. 2. The means 75 may also be implemented in other ways, e.g. via an electro-magnetic field that counters flow of liquid metal into the mold 33, or the like.

A casting operation using the casting apparatus 10 is carried out as follows. In the initial state, the starter block is in the top position such as to close the bottom opening 32 of the mold 30. Then, liquid metal is introduced into the mold cavity 33 via the metal supply system 70. The liquid metal is at least partially solidified by a heat transfer from the metal into the mold 30, e.g. the cooling jacket 34 thereof, forming a solidified outer layer on the molten metal. At the same time, the starter block 50 is moved vertically downwards while liquid metal is continuously supplied into the mold cavity 33 via the metal supply system 70. In this way, a longitudinal cast product 90 is produced in a continuous manner. When the casting of the cast product 90 is finished, the supply of liquid metal into the mold cavity 33 is interrupted and the vertical movement of the starter block 50 is stopped. Then, the cast product 90 is removed from the starter block 50. The empty starter block 50 is then moved vertically upwards such as to close the bottom opening 32 of the mold 30 and to bring the casting apparatus 10 into the initial state again. From this state, the next cast product 90 may be cast. With respect to terminology, the casting of a cast product 90 is referred to as "continuous casting" as the casting is carried out in a steady-state manner ("dynamic equilibrium") while the subsequent casting of several cast products 90 is referred to as "semi-continuous" casting or the like, as there is a discontinuity between casting of subsequent cast products 90 when the starter block 50 is moved upwards to the top position.

The present inventors have found and confirmed by experiments that the bleed-out phenomenon is related to a temperature increase on the surface of the cast product 90 exiting the bottom opening 32 of the mold 30. The present inventors have also found the causes for a temperature increase on the surface of a cast product 90 and present a method and an apparatus for casting that allows efficient casting with no or at least a reduced risk for bleed-outs and related injuries and damages.

Figure 3:
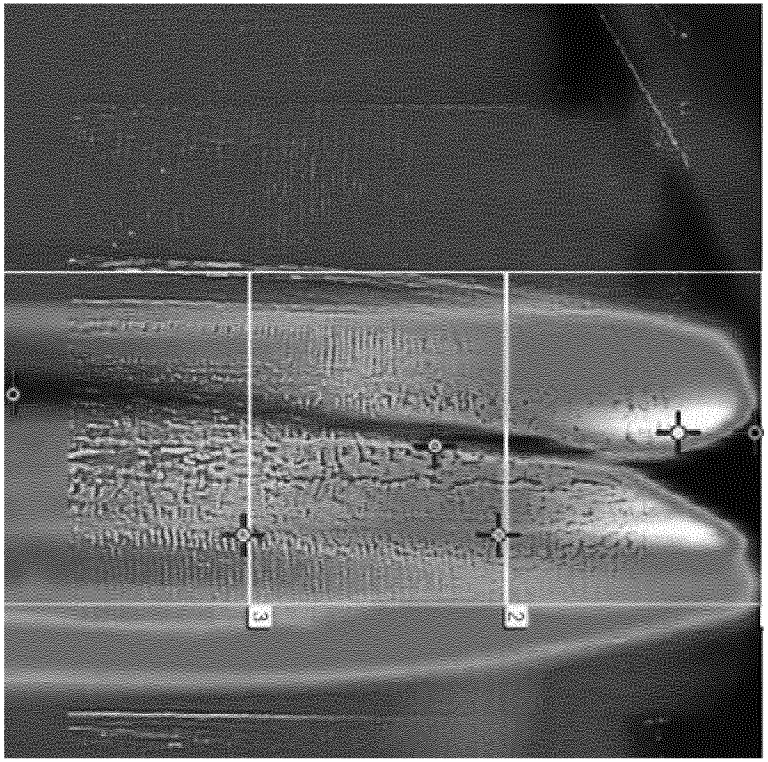
FIG. 3 shows a thermal image of a cast product shortly before a bleed out occurs.

Accordingly, the DC casting apparatus 10 further comprises a thermal imaging device or thermal camera 80 that is configured to record a thermal image (or a thermal vision video) of the cast product 90 during casting. A thermal image recorded by the thermal camera 80 may for example be an image of pixels arranged in a matrix (for example 320 columns and 240 rows or 1920 columns and 1080 rows), wherein a value of each pixel corresponds to thermal radiation that is incident on the thermal camera 80 on the corresponding location. The value of a pixel corresponds to the temperature of the recorded object. To record the thermal image, the thermal camera 80 may for example comprise a CCD detector. An example for a thermal camera 80 that can be used according to the present invention is for example the camera FLIR GF309 obtainable from FLIR Systems, Wilsonville, Oreg., USA. However, also other commercially available thermal cameras can be used as a thermal camera 80 according to the invention. The thermal camera 80 is arranged such that it records a thermal image of the cast product 90 exiting the bottom opening 32 of the mold 30. Hence, the thermal imaging device or thermal camera 80 should be arranged below the mold bottom opening 32. An example of a thermal image recorded using a thermal camera 80 according to the invention is shown in FIG. 3. The brighter areas represent higher temperatures compared to the darker areas. In practice, the thermal image may have colors indicating different temperatures.

The thermal camera 80 is connected to or comprises an electronic control system 100. The electronic control system 100 may be a computer, such as a standard PC. The electronic control system 100 may control the full operation of the cast apparatus 10. The electronic control system 100 determines a peak temperature of the cast product 90 that has exited the bottom opening 32 during a casting operation from the thermal image recorded by the thermal camera 80. The peak temperature is correspondingly the recorded maximum temperature of the cast product 90. The electronic control system 100 may according to embodiments also be connected to the metal supply system 70, e.g. the means 75 for stopping metal supply thereof. The electronic control system 100 is connected to an information output system (not shown), for example a computer display that can display information, a warning lamp, an audio alarm, or the like. To determine the peak temperature, any suitable algorithm may be used. A very simple algorithm to determine the peak temperature may comprise iterating over all the rows and columns of pixels forming the thermal image and comparing a present value with a previous value, and when the present value is higher than the previous value, replacing the previous value with the present value. The final value when the iteration over all rows and columns took place corresponds in this case to the peak temperature. However, depending on the conditions, also other algorithms may be used.

The electronic control system 100 is configured to execute the following actions depending on the maximum temperature that is determined by the electronic control system 100 based on the thermal image recorded by the thermal camera 80. When the maximum temperature falls within a first pre-defined temperature range, no additional action is taken, and the casting operation is executed in a semi-continuous manner as described above. When the maximum temperature falls within a second pre-defined temperature range, the casting process for the presently cast cast product 90 is carried out normally, but a signal is sent to the information output system that indicates that maintenance of the casting apparatus 10 is necessary. When the maximum temperature falls within the third pre-defined temperature range, a corresponding signal is sent to the information output system and the currently carried out cast process is interrupted, e.g. automatically or by an operator, by interrupting the metal flow into the mold cavity 33. The third temperature range is higher than the second temperature range and the second temperature range is higher than the first temperature range, wherein none of the temperature ranges are overlapping. The first pre-defined temperature range is also referred to as the normal operation temperature range, the second pre-defined temperature range is also referred to as the maintenance required temperature range and the third pre-defined temperature range is also referred to as the emergency shutdown temperature range. By careful analysis and experimentation, the present inventors have found that in the case of casting of aluminium or aluminium alloy (an aluminium alloy as described herein is an alloy comprising at least 70 wt-% Al), the following pre-defined temperature ranges using an emissivity of 1 for the thermal image may be used for efficient casting that safely prevents bleed-out:

First temperature range: up to 70° C.: normal operation

Second temperature range 70 to 90° C.: maintenance required

Third temperature range: higher than 90° C.: emergency shutdown temperature

However, the temperatures may be optimized and adapted according to the used casting apparatus 10, the casting parameters, the alloy, the cast house temperature, cast dimensions, etc. Empirical data and observations can be utilized to determine different temperature ranges adapted to a specific casting apparatus, casting parameters, a specific alloy, specific dimensions, etc. Tests can be performed to identify critical temperatures where there is a high risk of bleed-out. The pre-defined emergency shutdown temperature range must be set below such critical temperatures, providing a sufficient safety margin. The pre-defined maintenance required temperature range can be determined based on e.g. visual observations of the surface of the cast products, possibly while monitoring the temperature of the cast product which is output via the bottom opening of the mold. An uneven and/or poor surface quality of the cast product is an indicator that maintenance of the cast machine and/or the cooling system is needed. Normal operation temperatures usually provide good quality surface of the cast product.

The inventors have found that the following maintenance should be carried out on the casting apparatus 10 when the peak temperature is in the maintenance required temperature range or in the emergency shutdown temperature range. In particular, two types of maintenance may be carried out: a.) it should be ensured that the cooling medium supply is sufficient, and b.) it should be ensured that a wall of the mold 30 that enclosed the mold cavity 33 is free of contaminants. With respect to a.), for example, the flow rate may be limited by dirt that accumulates in the cooling jacket of the mold 30. With respect to b.), it has been found that often metal residue or other dirt on the wall of the mold 30 that surrounds the mold cavity 33 results in hot-spots on the cast products 90 that in turn develop into a bleed-out. Accordingly, casting according to the present invention may involve removing dirt from the cooling jacket and/or cleaning the wall of the mold 30 when the peak temperature is in the second temperature range or the third temperature range.

The method and apparatus according to the present invention has the advantages over the prior art that bleed-outs can be predicted and prevented by taking necessary actions based on the recorded thermal images. Hence, the present invention enables a safer and more efficient semi-continuous DC casting process reducing the risks of personnel injury and permanently damage of the casting apparatus.

The person skilled in the art realizes that the present disclosure is not limited to the preferred embodiments described above. The person skilled in the art further realizes that modifications and variations are possible within the scope of the appended claims. Additionally, variations to the disclosed embodiments can be understood and effected by the skilled person in practicing the claimed disclosure, from a study of the drawings, the disclosure, and the appended claims.

The invention claimed is:

1. A method for casting a longitudinal cast product (90) comprising:

casting the longitudinal cast product (90) in a semi-continuous manner using a direct chill (DC) casting apparatus (10) having a mold (30), wherein the mold (30) has top (31) and bottom (32) openings and is configured to at least partially solidify molten metal that is entered into the mold (30) via the top opening (31) and to output the cast product (90) via the bottom opening (32), recording a thermal image of the cast product (90) that is output via the bottom opening (32), determining at least three non-overlapping temperature ranges comprising a first temperature range, a second temperature range and a third temperature range, determining a peak temperature in the thermal image;

comparing the peak temperature with the at least three temperature ranges; and a.) when the peak temperature is comprised in the first temperature range, continue casting the cast product (90), b.) when the peak temperature is comprised in the second temperature range, displaying an information indicative of a maintenance requirement of the casting apparatus (10) and carrying out maintenance of the casting apparatus (10) after the cast product (90) is cast and before a subsequent casting operation is carried out, c.) when the peak temperature is comprised in the third temperature range, aborting the casting of the currently cast cast product (90) and displaying an information indicative of an emergency shutdown.

2. The method according to claim 1, wherein the first temperature range comprises temperatures up to but not including 70° C.

3. The method according to claim 1, wherein the second temperature range comprises temperatures between 70° C. and 90° C.

4. The method according to claim 1, wherein the third temperature range comprises temperatures higher than and not including 90° C.

5. The method according to claim 1, wherein the aborting the casting of the currently cast cast product (90) comprises stopping molten metal from entering into the mold (30).

6. The method according to claim 1, wherein the molten metal is at least partially solidified by removing heat from the mold cavity (33) into a cooling jacket (34) circulating a cooling medium.

7. The method according to claim 6, wherein the cast product is further solidified by direct water cooling immediately below the cooling jacket (34) or in the bottom opening (32) area of the mold.

8. A casting apparatus (10) for semi-continuous direct chill casting of a longitudinal cast product (90) comprising a mold (30) having a mold cavity (33) and a top opening (31) and a bottom opening (32) that are in fluid communication with the mold cavity (33), wherein the mold (30) is configured to at least partially solidify molten metal that is supplied into the mold cavity (33), a metal supply system (70) for selectively supplying the molten metal from a reservoir into the mold cavity (33) via the top opening (31), a starter block (50) that is configured such as to be vertically moveable between a high position in which it closes the bottom opening (32) of the mold (30) and a low position, and wherein the cast product (90) is produced by vertically moving the starter block (50) from the high position to the low position while supplying the molten metal into the mold cavity (33), a thermal camera (80), that is configured to record a thermal image of the cast product (90) while the starter block (50) is moved from the high position to the low position, an electronic control system (100) that is configured to determine a peak temperature in the thermal image and compare the determined peak temperature with at least a first temperature range, a second temperature range and a third temperature range, to control metal supply via the metal supply system and to control a vertical movement of the starter block (50), an information output system for outputting an information, wherein the electronic control system (100) controls the metal supply system (70) and the starter block (50) such as to produce the cast product (90) when the peak temperature is comprised in the first temperature range, wherein the electronic control system (100) controls the metal supply system (70) and the starter block (50) such as to produce the cast product (90) and controls the information output system to output an information indicating that maintenance of the casting apparatus (10) is necessary when the peak temperature is comprised in the second temperature range, wherein the electronic control system (100) controls the metal supply system (70) to stop supply of molten metal from the reservoir into the mold cavity (33) such as to abort casting of the cast product (90), when the peak temperature is comprised in the third temperature range.

9. The casting apparatus (10) according to claim 8, wherein the first temperature range comprises temperatures up to but not including 70° C.

10. The casting apparatus (10) according to claim 8, wherein the second temperature range comprises temperatures between 70° C. and 90° C.

11. The casting apparatus (10) according to claim 8, wherein the third temperature range comprises temperatures higher than and not including 90° C.

12. The casting apparatus (10) according to claim 8, wherein the thermal camera is arranged below the bottom opening (32) of the mold (30) to record the thermal image of the cast product (90) at least immediately below the bottom opening (32) of the mold (30).

13. The casting apparatus (10) according to claim 8, wherein the mold (30) comprise(s) a cooling jacket (34) for circulating a cooling medium.

14. The casting apparatus (10) according to claim 8, further comprising direct water cooling of the cast product immediately below the cooling jacket or in the bottom opening (32) area of the mold.

* * * * *